United States Patent [19]

Watkins

[11] 4,456,070

[45] Jun. 26, 1984

[54] TIEBACK CONNECTION METHOD AND APPARATUS

[75] Inventor: Bruce J. Watkins, Palos Verdes, Calif.

[73] Assignee: Hughes Tool Company, Houston, Tex.

[21] Appl. No.: 401,508

[22] Filed: Jul. 26, 1982

[51] Int. Cl.[3] ..... E21B 43/01

[52] U.S. Cl. ..... 166/345; 166/344; 285/18

[58] Field of Search ..... 166/345, 344, 367, 368, 166/350, 359; 285/DIG. 18, 18, 341; 405/169

[56] References Cited

U.S. PATENT DOCUMENTS

| | | | |
|---|---|---|---|
| 3,201,147 | 8/1965 | DeCenzo | 285/1 |
| 3,220,245 | 11/1965 | Van Winkle | 285/18 |
| 3,222,088 | 12/1965 | Haeber | 285/18 |
| 3,347,567 | 10/1967 | Watkins | 285/24 |
| 3,452,815 | 7/1969 | Watkins | 166/344 |
| 3,485,051 | 12/1969 | Watkins | 405/204 |
| 3,492,027 | 1/1970 | Herring | 285/18 |
| 3,493,043 | 2/1970 | Watkins | 166/344 |
| 3,613,726 | 10/1971 | Torres | 285/86 X |
| 3,779,313 | 12/1973 | Regan | 166/208 X |
| 3,895,831 | 7/1975 | Fisher | 285/DIG. 18 X |
| 3,918,747 | 11/1975 | Putch | 166/208 X |
| 4,326,328 | 4/1982 | Watkins | 29/464 |
| 4,333,528 | 6/1982 | Woodman | 166/117.5 |

*Primary Examiner*—Stephen J. Novosad

*Assistant Examiner*—Thuy M. Bui

*Attorney, Agent, or Firm*—Robert A. Felsman

[57] ABSTRACT

A tieback connection apparatus effects a metal-to-metal type seal between a riser run from an overhead vessel and a subsea well casing suspended from a casing hanger in a subsea wellhead member. The apparatus includes a tubular mandrel connected to and run by the riser into the wellhead, and a metal-to-metal type annular seal mounted at the lower end of the mandrel. The end of the mandrel is positioned in coaxial alignment with the casing hanger with the seal ring position between the mandrel and the hanger to effect a seal between the riser and the casing when compressive force is applied to the seal ring. A seal activating mechanism, associated with the mandrel and operated by a tool run from the vessel, engages the casing hanger and applies the compressive force to effect the seal. The seal activating mechanism includes a locking collet, a reaction sleeve, and a drive sleeve. Rotation of the drive sleeve by the operating tool moves the reaction sleeve into contact with the collet to maintain locking engagement between the casing hanger and the collet. The collet also prevents further movement of the reaction sleeve whereby further rotation of the drive sleeve causes the reaction sleeve to apply the compressive force to the mandrel, seal ring and casing hanger. A method is also provided for effecting a metal-to-metal type seal between the riser and the casing.

14 Claims, 8 Drawing Figures

TIEBACK CONNECTION METHOD AND APPARATUS

CROSS-REFERENCE TO RELATED APPLICATION

This application and an application filed by me entitled "TIE-BACK CONNECTION APPARATUS AND METHOD" filed July 26, 1982, Ser. No. 402,180 contain some common subject matter.

FIELD OF THE INVENTION

The present invention relates to the remote latching and sealing of a riser run from a floating vessel to a subsea wellhead.

BACKGROUND OF THE INVENTION

In offshore production well systems it is desirable to be able to quickly and effectively reconnect a riser from an overhead vessel to a casing in a subsea wellhead. One of the primary problems which must be overcome in so doing, however, is the difficulty in creating an effective seal between the riser and the casing. One of the seals that has been utilized in subsea connections is a metal-to-metal type seal.

The metal-to-metal type seal, to be effective, requires that a high compressive force be placed on it. The mechanisms previously used in connection with the metal-to-metal seal have been complicated and cumbersome and have not provided the desired degree of sealing between the riser and the subsea casing. As a result, the remote latching and sealing of the tieback string to the wellhead has gone neither as smoothly, nor as quickly, as desired.

Accordingly, it is the principal object of the present invention to remotely latch and seal a tieback string to a production wellhead.

Another object of this invention is to remotely latch and seal a tieback string to a production wellhead quickly and efficiently.

A further object of this invention is to apply compressive force to a metal-to-metal type seal with an uncomplicated mechanical arrangement.

SUMMARY OF THE INVENTION

The present invention, in a broad aspect, provides a tieback connector apparatus to effect a metal-to-metal type seal between a riser run from an overhead vessel and a subsea well casing suspended from a casing hanger in a subsea wellhead member. The apparatus includes a tubular mandrel connected to and run by said riser into the subsea wellhead member, with the bore of the mandrel communicating with the bore of the riser. A metal-to-metal type annular seal is mounted at a lower end of the mandrel. The lower end of the mandrel is guided into the wellhead member in coaxial alignment with the casing hanger, with the seal ring positioned therebetween. Mating metal-to-metal surfaces are provided between the seal ring and the lower end of the mandrel and the casing hanger to effect a seal therebetween upon application of the compressive force thereon. A seal activating mechanism associated with the mandrel engages the casing hanger and applies this compressive force to seal the connection thus effected between the riser and the casing.

In accordance with one feature of the invention, an operating tool run from the vessel to the riser and into the mandrel applies a rotative force to the seal activating mechanism, which transforms the rotative force into the desired compressive force.

In accordance with yet another feature of the invention, the seal activating mechanism includes a locking collet suspended from the mandrel and extending into the bore of the casing hanger to engage the hanger. The mechanism also includes a drive sleeve rotatably mounted within the mandrel and a reaction sleeve threadingly engaging the drive sleeve and constrained for vertical movement relative to the locking collet. Rotation of the drive sleeve brings the reaction sleeve into contact with the locking collet to maintain the locking collet in locking engagement with the casing hanger. The locking collet acts as a stop for the reaction sleeve whereby the reaction sleeve draws the mandrel against the casing hanger to apply compressive force to the seal ring in response to further rotation of the drive sleeve.

In accordance with a further feature of the invention, the operating tool includes a tool body run by tubing from said vessel through the riser into the mandrel. A vertical registration apparatus, including a locking collet, properly positions the tool body in the drive sleeve. Dogs extending from the tool body engage the drive sleeve, whereby rotation of the operating tool rotates the drive sleeve to apply compressive force to the seal ring.

In accordance with yet another feature of the invention, a method of effecting a metal-to-metal type seal between the riser and the subsea well casing includes lowering of the mandrel with the seal into the subsea well member, landing the seal in coaxial alignment with the casing hanger to create a connection between the riser and the casing, and applying the compressive force to the seal ring to seal the connection.

Other objects, features, and advantages of the present invention will become apparent by consideration of the following detailed description and from the accompanying drawings.

DETAILED DESCRIPTION

Figure 1:
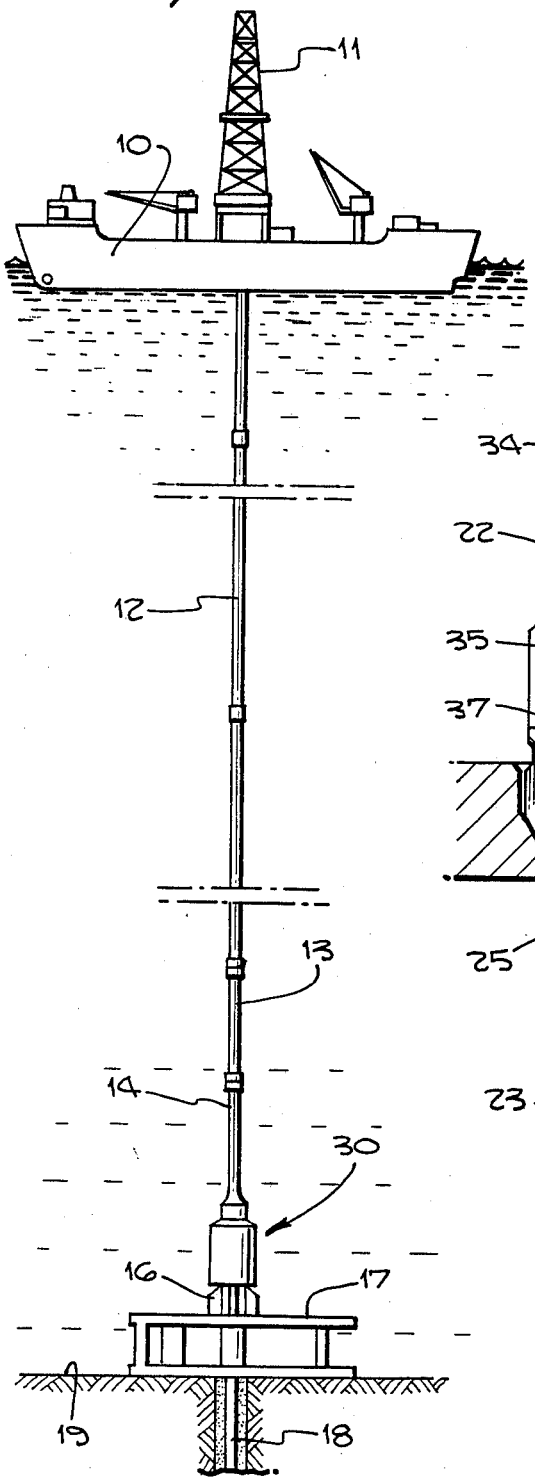
FIG. 1 is a schematic view of a vessel positioned over a seafloor template and having a descending pipe string provided with the tieback connection apparatus of the present invention.

Referring more particularly to the drawings, FIG. 1 shows a schematic view of a subsea production well system including a well 18 on the subsea floor 19. The well 18 is connected to a template 17 having mounted thereon a wellhead assembly 16. Attached to the wellhead assembly 16 is a tieback connection apparatus 30 according to the present invention, which itself is connected to a tapered joint 14 attached to a riser joint 13 connected to a riser 12 from a rig 11 on a floating vessel 10.

Figure 2:
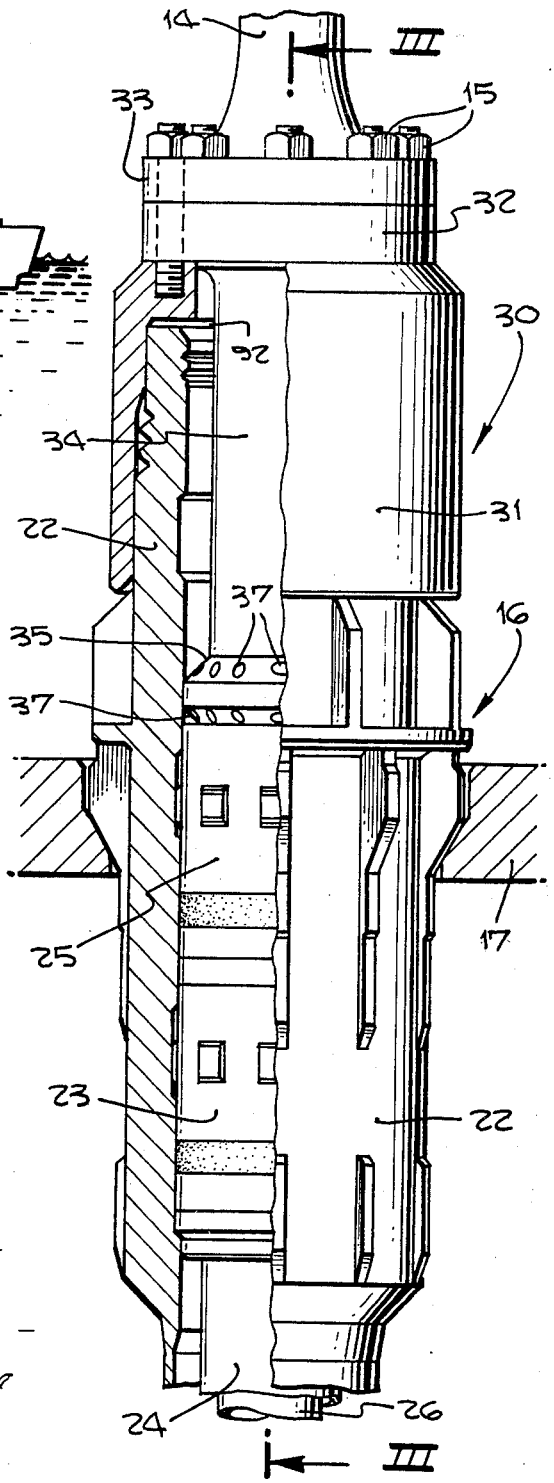
FIG. 2 is an elevational view, partially in section, of the tieback connection apparatus when landed in a subsea wellhead.

As shown in FIG. 2, the tieback connection apparatus 30 includes an outer flange or guide skirt 31 having a top flange 32 bolted by bolts 15 to a bottom flange 33 on the tapered joint 14. The tieback connector also includes a tubular inner body or mandrel 34 having a guide spool 35 with a plurality of vertical through passages 36 to allow fluid communication on either side of the guide spool 35.

The wellhead assembly 16 includes a wellhead housing 22. The wellhead 22 has landed therein a lower casing hanger 23 supporting a casing 24. Above the casing hanger 23 and the wellhead 22 is landed another casing hanger 25 supporting another casing 26.

It is between the casing 26 and the riser 12 that a seal is effected by the tieback connection apparatus of the present invention. More specifically, the seal is effected between the lower end 34*e* of the mandrel 34 and the lower body portion of 25*d* of the casing hanger 25.

Figure 3A:
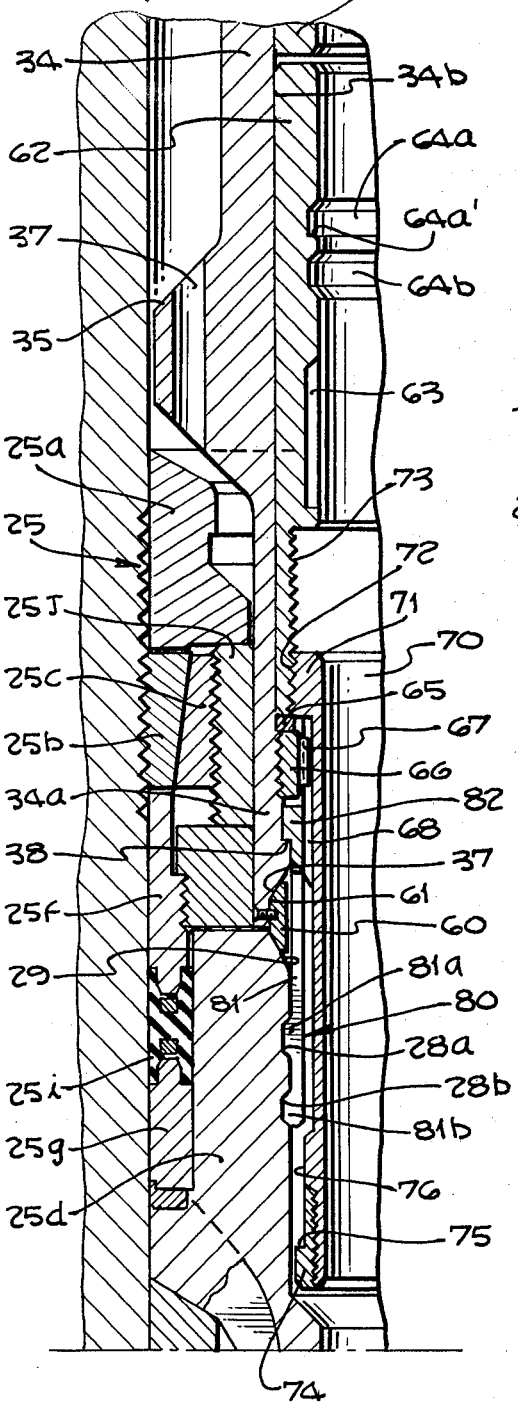
FIG. 3*a* is an enlarged fragmentary sectional view showing the lowermost portion of the tieback connection apparatus landed in the subsea wellhead.
Figure 3B:
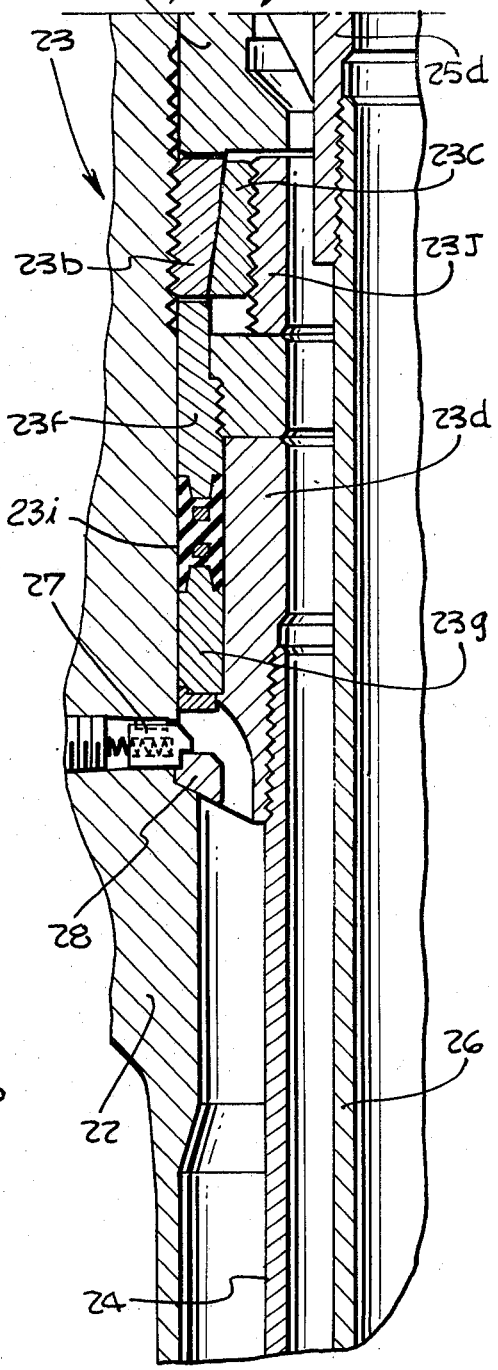
FIG. 3*b* is an enlarged fragmentary sectional view of the subsea wellhead taken below FIG. 3*a;*

FIGS. 3*a* and 3*b* show the arrangement of the casing hangers 23 and 25 in more detail. As shown therein, the lower casing hanger 23 includes a body 23*d*, an upper body 23*a*, a plurality of hanger dogs 23*b* urged outwardly by an annular wedge 23*c* adjacent a collar 23*j*. A seal is effected between the casing hanger 23 and the wellhead 22 by an annular seal 23*i* disposed between two annular seal retainers 23*f* and 23*g*. The casing 24 is threaded onto the hanger body 23*d*. A plurality of latches 27 mounted in the wellhead 22 engage a shoulder 28 in the casing hanger to retain the casing hanger 23 within the wellhead 22.

Casing hanger 25 has a similar construction to casing hanger 23 and includes a body 25*d*, and upper body 25*a*, a plurality of hanger dogs 25*b*.maintained in position by an annular wedge 25*c* threaded onto a collar 25*j*. A seal 25*i* is positioned between seal retainers 25*f* and 25*g*. From the casing hanger body 25*d* is suspended a casing 26.

Figure 5A:
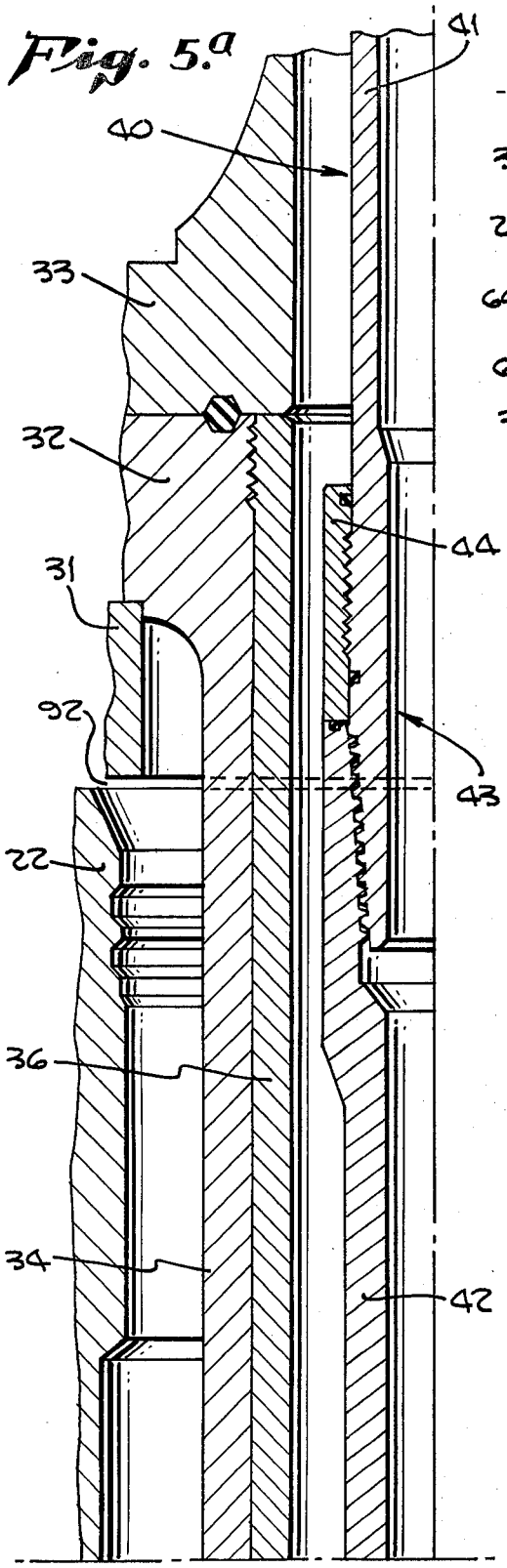
FIG. 5*a* is an enlarged fragmentary sectional view showing the upper portion of the subsea wellhead with the tieback connection apparatus, including the operating tool, positioned therein.
Figure 5B:
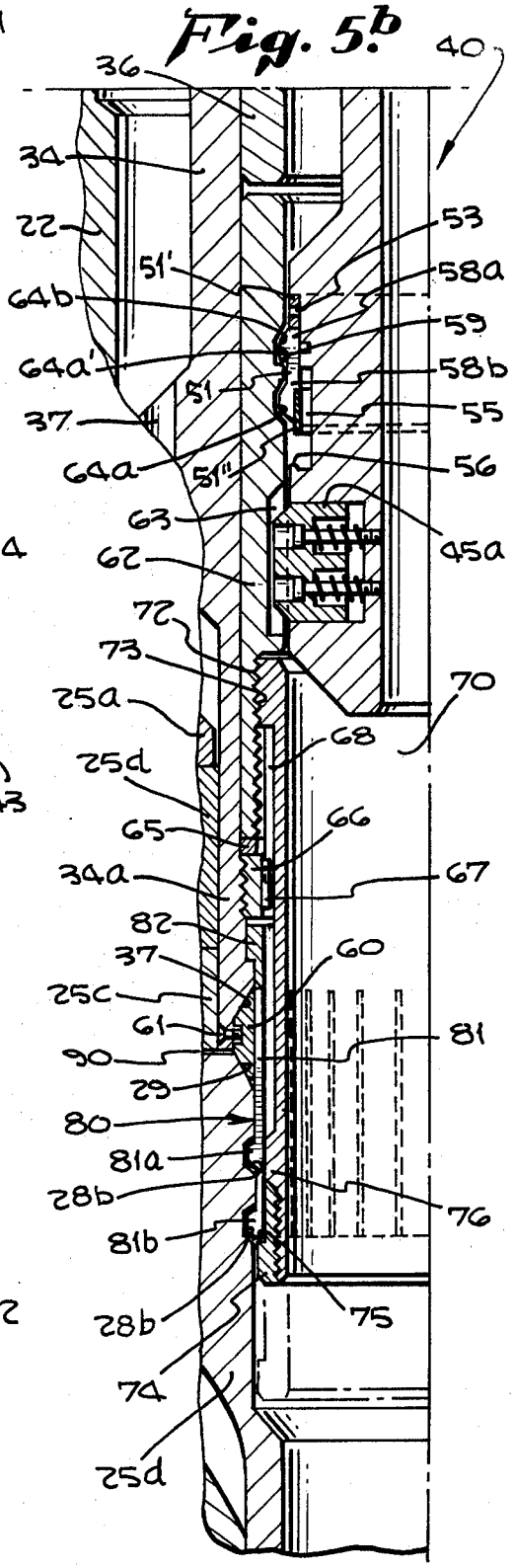
FIG. 5*b* is an enlarged fragmentary sectional view of the tieback connection apparatus, including the operating tool, taken below FIG. 5*a,* after the seal between the piping string from the vessel and the subsea wellhead has been effected.

As shown in FIG. 5*b*, the tieback connection apparatus extends downwardly into the casing hanger 25 and effects a metal-to-metal seal between the mandrel 34 and the body 25*d* of the upper casing hanger 25. In this regard, the lower end 34*a* of the mandrel 34 has attached thereto a metal-to-metal type seal 60 by retainer bolts 61 or the like. The metal-to-metal seal is preferrably a type AX metal-to-metal seal.

The lower end 34*a* of the mandrel 34 has a tapered seat 37 mating with a tapered back side of the seal 60. Similarly, the hanger body 25*d* of the casing hanger 25 likewise has a tapered seat 29 which mates with the tapered back side of the seal 60. As explained below, the mating metal-to-metal surfaces between the seal 60 and the tapered seats 37 and 29 in the lower end of the tubular mandrel 34*a* and on the hanger body 25*d*, respectively, effect a seal between the mandrel 34, the seal 60, and the casing hanger 25 upon the application of compressive force therebetween. The compressive force is transferred by the tapered seats 37 and 29 to the seal 60. Spaces 90 and 92, between the mandrel 34 and the casing hanger body 25 and between the guide skirt 31 and the wall head 22, respectively, allow the mandrel 34 to move downwardly to transfer the compressive loading to the seal 60.

The latching of the tieback connection apparatus 30 to the casing hanger 25 is accomplished by a locking collet, generally denoted 80, suspended by a rim portion 82 from a shoulder 38 in the lower end 34*a* of the tubular mandrel. The locking collect 80 includes a plurality of fingers 81, with each finger having thereon an upper dog 81*a* and a lower dog 81*b*. The series of upper dogs 81*a* forms an upper annular dog ring, and the series of lower dogs 81*b* forms a lower annular dog ring on the locking collet 80.

The upper dogs 81*a* and the lower dogs 81*b* engage annular recesses 28*a* and 28*b*, respectively, in the casing hanger body. Engagement between the upper and lower dogs 81*a* and 81*b* and the upper and lower annular recesses 28*a* and 28*b* is maintained by means of a reaction sleeve 70 also suspended from the mandrel 34 into the casing hanger body 25*d*. The reaction sleeve 70 is mounted to the mandrel 34 by means of threads 72 which engage corresponding threads 73 on a drive sleeve 62 rotatably mounted on a bearing 65 supported on a collar 66 threaded onto the mandrel 34. The reaction sleeve 70 is provided at its lower end with a collect cam surface 76. Threaded onto the lower end of the reaction sleeve 70 is also an annular stop-collar 74 having an upwardly-positioned stop-shoulder 75.

The reaction sleeve 70 is constrained to move only vertically relative to the collet 80 by means of a spline mechanism having a plurality of spline keys 67 attached to the collar 66 supporting the bearing 65, and engaging a plurality of keyways 68 formed on the reaction sleeve 70.

Figure 6:
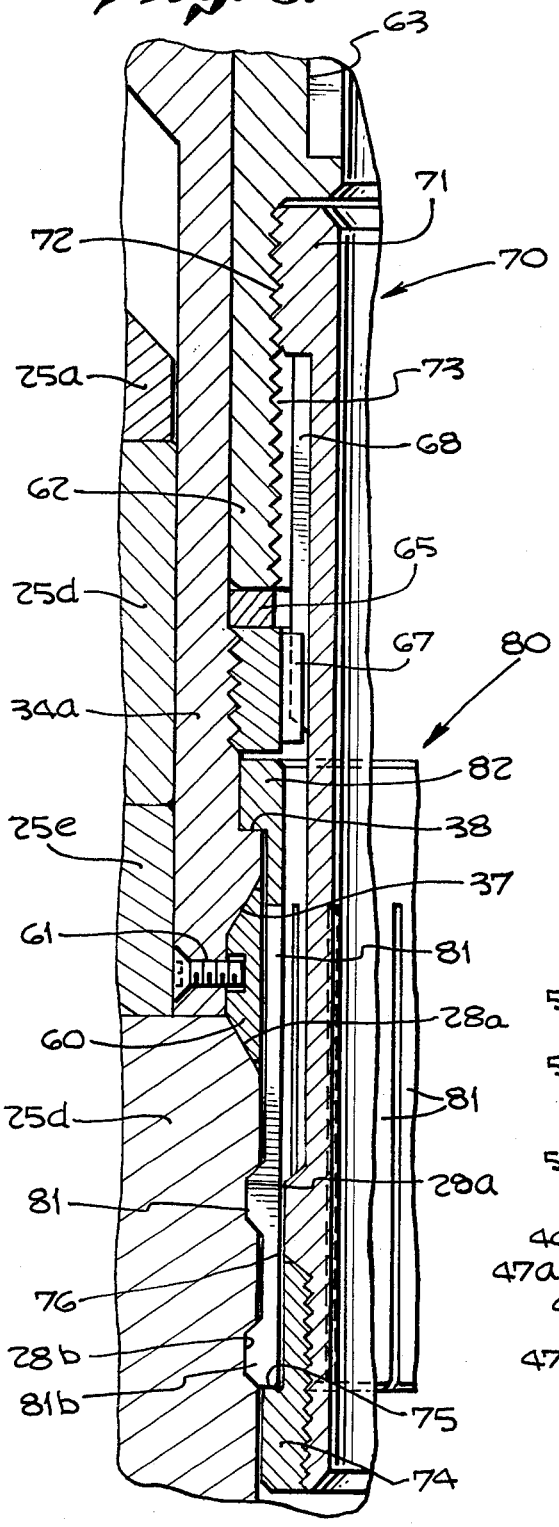
FIG. 6 shows an enlarged fragmentary view of the seal effected between the pipe string and the subsea wellhead after the operating tool has been removed from the wellhead.

Rotation of the drive sleeve 62 moves the reaction sleeve 70 vertically upward from the position shown in FIG. 3*a* to the position shown in FIGS. 5*b* and 6. The position of the reaction sleeve 70 as shown in FIG. 3*a* is the position where the reaction sleeve is located when the tieback connection apparatus 30 is first lowered into the wellhead housing 16. In this position, the collet cam 76 and the stop-shoulder 75 are positioned away from the locking fingers 81 so that the locking fingers 81 can move radially inward to follow the contour of the casing hanger 25 without getting caught thereon as the tieback connector 30 is lowered into the wellhead casing 16.

Turning the drive sleeve 62 causes the reaction sleeve 70 to bring the collet cam 76 up behind the collet fingers 81 to maintain the upper and lower dogs 81*a* and 81*b* on the collet fingers 81 in locking engagement with the upper and lower annular recesses 28*a* and 28*b* on the hanger body 25*d*. The reaction sleeve 70 is raised by the drive sleeve 62 until the stop-shoulder 75 abuts the bottom of the locking fingers 81. The locking collet 80 acts as a stop for the reaction sleeve 70. Further rotation of the drive sleeve 62 draws the mandrel 34 tightly against the hanger body 25*d*, thereby placing the seal 60 under compression. The final position of the reaction sleeve 70 is shown in FIG. 6. The arrangement of the tapered seat 29 on the hanger body 25*d* and the corresponding mating surface on the seal 60 results in the seal 60 and the mandrel 34 coming into contact with the casing hanger body 25*d*. The tapered seats 37 and 29 on the mandrel 34 and the the casing hanger 25*d* to transmit the compressive loading to the seal 60 as the mandrel 34 is drawn into the casing hanger 25 by the reaction sleeve 70. As shown in FIG. 6, no space remains between the mandrel 34 and the casing hanger body 25*d* after the seal 60 has been placed under compression by the reaction sleeve 70.

The drive sleeve 62 which draws the reaction sleeve 70 upward is shown in more detail in FIGS. 5*b* and 6. The drive sleeve 62 comprises a generally cylindrical member mounted for rotation on a bearing 65. The drive sleeve 62 is provided with a plurality of dog-receiving recesses 63 through which rotative motion is imparted to the drive sleeve 62 by an operating tool described hereinbelow to move the reaction sleeve vertically upward to apply the compressive force to the seal ring 60. The drive sleeve 62 is likewise provided with a pair of locating dog recesses 64*a* and 64*b* which are used for proper positioning of the operating tool. One of the locating dog recesses 64*a* is provided with a shoulder 64*a*′ which initiates the positioning process.

Figure 4:
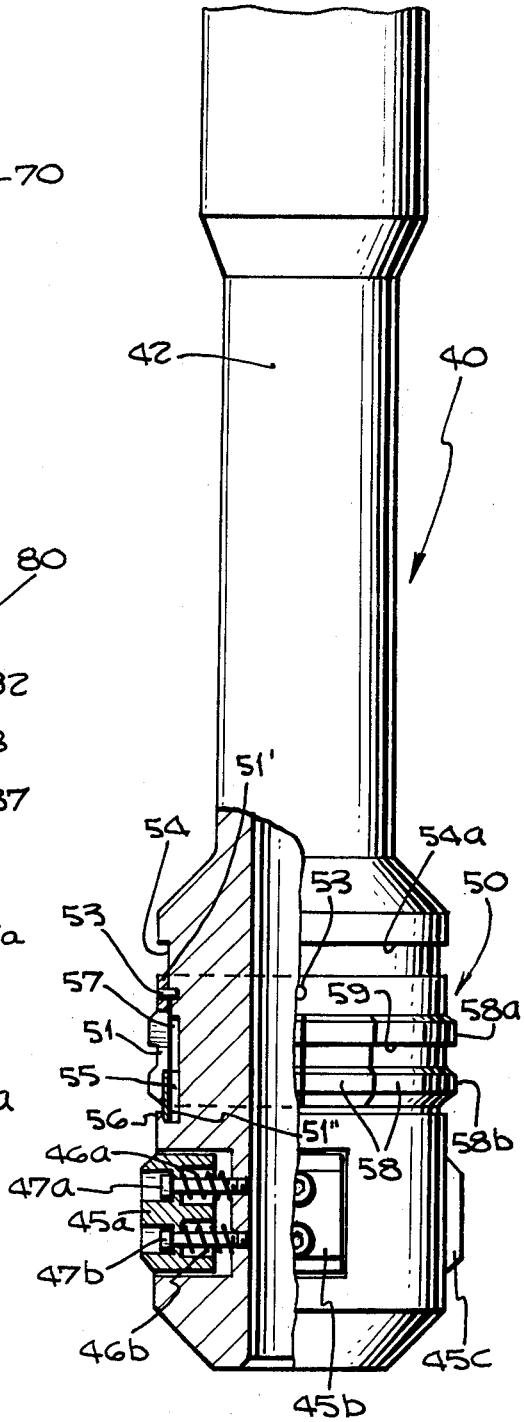
FIG. 4 is an elevational view, partially in section, of the operating tool portion of the tieback connection apparatus.

FIGS. 4 and 5*b* show the operating tool 40 which is used to rotate the drive sleeve 62. As shown therein, the operating tool 40 includes a tool body having an upper part 42 attached to a running string 41 connected to the floating vessel 10 by tubing not shown in the figures. The running string 41 is connected to the tool body 42 through a couplling 43 as known in the art and shown in FIG. 5*a*. The coupling 43 is described more fully in U.S. Pat. No. 3,762,745, the description of which is incorporated by reference herein. The coupling 43 includes a tapered acme thread with extra clearance to allow axial movement between the pin and box portions of the thread. The threads are splined at the lower engaging end such that a nut 44 is tightened to pull the pin upward and engage the splines and thereby provide both locking and unlocking torque to the tool 40. Stated differently, the turning of the running string 41 tightens the collar in the acme/spline thread arrangement to allow the loose thread to move axially and engage the splined thread to allow rotation of the tool 40 in the direction of rotation of the running string 41.

The tool body 42 is provided with a plurality of spring biased dogs 45*a*, 45*b*, and 45*c* which engage the dog receiving recesses 63 on the drive sleeve 42. Each of these dogs 45 is attached to a pair of retaining bolts 47*a* and 47*b*, each having positioned on its shank a spring 46*a* and 46*b* to urge the dogs 45*a*, 45*b*, and 45*c* outwardly from the tool body 42 to follow the contours of the wellhead 22 and drive sleeve 62 until properly positioned within the dog receiving recesses 63.

Proper vertical registration of the operating tool 40 in the drive sleeve 62, whereby the spring biased dogs 45 are located in the dog receiving recesses 63, is insured by means of a generally annular locking collet 50 disposed upon the tool body 42. The locking collet 50 includes an annular band 51″ supporting a plurality of fingers 58 formed below a stop ring 51′. Each finger includes an upper dog 58*a* and a lower dog 58*b*, forming two adjacent dog rings. The contours of the dogs 58*a* and 58*b* are different and correspond to the contours in the locating dog recesses 64*a* and 64*b*. The upper dogs 58 are also provided with a rim 59 corresponding to the shoulder 64*a*′ in the upper locating dog recess 64*a*. The purpose of the rim 59 is to engage the shoulder 64*a*′ as the operating tool 40 is lowered into the drive sleeve 62.

As shown in more detail in FIG. 4, the locking collet 50 is disposed initially adjacent an annular recess 57 on the tool body 42. A plurality of shear pins 53 extend through the stop ring 51′ to maintain the collet 50 in this position.

As the operating tool is lowered into the drive sleeve 62, the spring biased dogs 45 first encounter the locating dog recesses 64*a*, 64*b* in the drive sleeve and slide past the recesses due to the lack of correspondence between the contours on the dogs 45 and the contours of the recesses 64*a* and 64*b*. As the operating tool 40 continues to be lowered into the drive sleeve 62, the lower dog 58*b* on each finger 58 of the locking collet 50 encounters the upper dog locating recess 64*b*, but does not engage it because of the differing contours. The upper dog 58*a* next makes contact with the upper locating dog recess 64*b* and the rim 59 on the upper dog 58 engages the shoulder 64*a*′ in the locating dog recess 64*a*. This engagement prevents further movement of the locking collet 50 and results in the locking collet 50 sliding upward into another recess 54 in the tool body. As this occurs, the shear pins 53 are sheared off by the band 52. Further downward movement of the operating tool ceases when the band 52 engages a flange 54*a* formed by a recess 54 on the tool body 42. At this point, the spring biased dogs 45 are vertically located in line with the dog receiving recesses 63. Rotation of the tool body 42 allows the dogs 45 to engage the dog receiving recesses 63. Rotation of the drive sleeve 62 may be effected to move the reaction sleeve 70 upward to effect a seal between the casing hanger body 25*d* and the lower end of the mandrel 34*a*, in the manner described previously.

After the seal has been effected, the operating tool is pulled upwardly out of the drive sleeve 62. The tapered upper contours of the locating dogs 58*a* and 58*b* on the fingers 58 and on the spring biased dogs 45 facilitate removal of the tool.

The operating tool 40 may be reinserted into the drive sleeve 62 in order to release the seal between the tubing mandrel 34 and the casing hanger body 25*d* by rotating the drive sleeve 62 to move the reaction sleeve downwardly and thus position the collet cam 76 below the locking fingers 81.

As seen from the foregoing, the present invention provides a novel method and apparatus for remotely latching and sealing a tieback string to a wellhead. As discussed hereinabove, the attaching of the tieback connector 30 to the wellhead 22 is accomplished by inserting the mandrel 34 into the wellhead 22 with the guide skirt 31 and the guide spool 35 respectively following the inner and outer contours of the wellhead. The ports 36 in the guide spool 35 allow displacement of fluid through the guide spool to facilitate the lowering of the mandrel 34 into the wellhead 22. The lowering continues until the seal 60 contacts the tapered seat 29 on the casing hanger body 25*d*.

Once the mandrel has landed, the operating tool described above is inserted into the drive sleeve 62 to rotate the sleeve and thereby raise the reaction sleeve 70 to urge the collet cam 76 behind the locking fingers 81 of the locking cam disposed adjacent the casing hanger body 25*d*. The operating tool is further rotated to apply a tension load to the reaction sleeve 70 and thus effect a seal between the mandrel and the casing.

In the foregoing description of the present invention, a preferred embodiment of the invention has been disclosed. It is to be understood that other mechanical and design variations are within the scope of the present invention. Accordingly, the invention is not limited to the particular arrangement which has been illustrated and described in detail herein.

What is claimed is:

1. A method of effecting a metal-to-metal type seal between a riser run from an overhead vessel and a subsea well casing suspended from a casing hanger in a subsea wellhead member, said method comprising the steps of:

lowering a mandrel attached to said riser and having a metal-to-metal type annular seal mounted at a lower end thereof into said subsea well member;

landing said annular seal on and in coaxial alignment with said casing hanger, whereby a connection between said riser and said casing is effected; and mechanically applying an axial compressive force to said annular seal, said mandrel, and said casing hanger to seal said effected connection.

2. A method of effecting a metal-to-metal type seal between a riser run from an overhead vessel and a subsea well casing suspended from a casing hanger in a subsea wellhead member, said method comprising the steps of:

lowering a mandrel attached to said riser and having a metal-to-metal type annular seal mounted at a lower end thereof into said subsea well member;

landing said annular seal on and in coaxial alignment with said casing hanger, whereby a conection between said riser and said casing is effected; and mechanically applying a compressive force to said annular seal, said mandrel, and said casing hanger to seal said effected connection;

said step of applying compressive force comprising the steps of:

positioning a locking collet and an associated reaction sleeve suspended from said mandrel adjacent said casing hanger;

rotating a drive sleeve mounted in said mandrel in threaded engagement with said reaction sleeve, and simultaneously constraining said reaction sleeve to vertical movement in response to said rotation of said drive sleeve; and moving said reaction sleeve vertically upward by said rotation of said drive sleeve until said reaction sleeve contacts said locking collet whereupon further rotation of said drive sleeve draws said mandrel toward said casing hanger to apply said compressive force to said mandrel, said annular seal, and said casing hanger to effect said metal-to-metal seal.

3. A method of effecting a metal-to-metal type seal between a riser run from an overhead vessel and a subsea well casing suspended from a casing hanger in a subsea wellhead member, said method comprising the steps of:

lowering a mandrel attached to said riser and having a metal-to-metal type annular seal mounted at a lower end thereof into said subsea well member;

landing said annular seal on and in coaxial alignment with said casing hanger, whereby a connection between said riser and said casing is effected; and mechanically applying a compressive force to said annular seal, said mandrel, and said casing hanger to seal said effected connection;

said step of applying compressive force comprising the steps of:

positioning a locking collet and an associated reaction sleeve suspended from said mandrel adjacent said casing hanger;

rotating a drive sleeve mounted in said mandrel in threaded engagement with said reaction sleeve, and simultaneously constraining said reaction sleeve to vertical movement in response to said rotation of said drive sleeve; and moving said reaction sleeve vertically upward by said rotation of said drive sleeve until said reaction sleeve contacts said locking collet whereupon further rotation of said drive sleeve draws said mandrel toward said casing hanger to apply said compressive force to said mandrel, said annular seal, and said casing hanger to effect said metal-to-metal seal;

said step of rotating said drive sleeve comprising the steps of;

moving an operating tool downwardly into said drive sleeve until dogs on said operating tool are positioned within dog receiving recesses on said drive sleeve; and rotating said running tool to urge said dogs against said recesses to turn said drive sleeve.

4. A tieback connector apparatus for effecting a metal-to-metal type seal between a riser run from an overhead vessel and a subsea well casing suspended from a casing hanger in a subsea wellhead member, said connection apparatus comprising:

a tubular mandrel connected to and run by said riser into said subsea wellhead member, the bore of said mandrel communicating with the bore of said riser;

a metal-to-metal type annular seal ring mounted at the lower end of said mandrel, said mandrel lower end and said seal ring having mating metal-to-metal surfaces to effect a seal therebetween upon application of compressive force thereon;

guide means for guiding said mandrel within said wellhead member to position said mandrel lower end in coaxial alignment with said casing hanger with said seal ring positioned therebetween, said seal ring and said casing hanger having mating metal-to-metal surfaces to effect a seal therebetween upon application of compressive force thereon; and seal activating means, associated with said mandrel and engaging said casing hanger and responsive to a rotative force applied in said riser, for applying a compressive force between said seal ring, mandrel, and casing hanger in responsse to said rotative force to seal the connection thus effected between said riser and said casing.

5. An apparatus as defined in claim 1, wherein said apparatus further comprises:

an operating tool run from said vessel through said riser into said mandrel to apply said rotative force to said seal activating means, said seal activating means transforming said rotative force into said compressive force.

6. A tie-back apparatus for effecting a metal-to-metal seal between a riser run from an overhead vessel and a subsea well casing suspended from a casing hanger in a subsea wellhead, said apparatus comprising:

a hollow mandrel connected to and run by said riser into said wellhead, said mandrel having a bore communicating with the bore of said riser;

metal seal ring means disposed at the lower end of said mandrel, whereby said ring means is landed upon said casing hanger when said mandrel is run into said wellhead;

seal compressing means, associated with said mandrel and engaging said casing hanger and responsive to a rotative force applied in said riser, for applying a compressive force between said ring means, said mandrel, and said casing hanger in response to said rotative force to seal said riser to said casing; and operating tool means, run from said vessel into said mandrel, for applying said rotative force to said seal compressing means, said seal compressing means transforming said rotative force into said compressive force.

7. A tie-back apparatus for effecting a metal-to-metal type seal between a riser run from an overhead vessel and a subsea well casing suspended from a casing hanger in a subsea wellhead, said apparatus comprising:

a hollow mandrel connected to and run by said riser into said subsea wellhead, said mandrel having a bore communicating with the bore of said riser;

metal-to-metal seal ring means;

fastening means for mounting said seal ring means at the lower end of said mandrel, whereby said seal ring means is landed upon said casing hanger when said mandrel is run into said wellhead;

seal compressing means, associated with said mandrel and engaging said casing hanger and responsive to a rotative force applied in said riser, for applying a compressive force between said ring means, said mandrel, and said casing hanger in response to said rotative force to seal said riser to said casing;

mating metal-to-metal surfaces on said mandrel lower end, said ring means, and said casing hanger, said metal surfaces on said mandrel and said casing hanger each comprising a tapered annular seat, and said metal surfaces on said ring means comprising a tapered annular shoulder, whereby said seats abut said shoulders to transfer said applied compressive force to said shoulder to effect a seal between said riser and said casing; and guide means for guiding and maintaining said mandrel lower end in coaxial alignment with said casing hanger with said ring means positioned therebetween, said guide means including a guide skirt attached to said mandrel and contacting an upper outer surface of said wellhead, and a guide spool attached to said mandrel and contacting an inner surface of said wellhead, said guide spool being disposed below said guide skirt and including a plurality of through-bores for allowing fluid communication vertically through said spool; and operating tool means, run from said vessel into said mandrel, for applying said rotative force to said seal compressing means, said seal compressing means transforming said rotative force into said compressive force.

8. A tie-back connection apparatus for effecting a metal-to-metal type seal between a riser run from an overhead vessel and a subsea well casing suspended from a casing hanger in a subsea wellhead member, said connection apparatus comprising:

a tubular mandrel connected to and run by said riser into said subsea wellhead member, the bore of said mandrel having a bore communicating with the bore of said riser;

a metal-to-metal type annular seal ring mounted at the lower end of said mandrel, said mandrel lower end and said seal ring having mating metal-to-metal surfaces to effect a seal therebetween upon application of compressive force thereon;

guide means for guiding said mandrel within said wellhead member to position said mandrel lower end in coaxial alignment with said casing hanger with said seal ring positioned therebetween, said seal ring and said casing hanger having mating metal-to-metal surfaces to effect a seal therebetween upon application of compressive force thereon;

locking collet means, suspended from said mandrel and extending into the bore of said casing hanger, for engaging said casing hanger;

drive sleeve means rotatably mounted within said mandrel;

reaction sleeve means, threadingly engaging said drive sleeve means and constrained for vertical movement relative to said locking collet means, for maintaining said locking collet means into locking engagement with said casing hanger and for drawing said mandrel against said casing hanger to apply said compressive force to said mandrel, said casing, and said seal ring, in response to rotation of said drive sleeve means; and an operating tool run from said vessel through said riser into said mandrel to apply said rotative force to said drive sleeve means to effect said seal between said riser and said casing.

9. An apparatus as defined in claim 8, wherein:

said casing hanger includes dog receiving means for receiving said locking collet means;

said locking collet means includes plurality of locking finger means, each having a plurality of dog means to engage with said dog receiving means on said casing hanger; and said reaction sleeve means includes cam means for maintaining said dog means in said dog receiving means and further includes stop means for limiting vertical movement of said reaction sleeve means, whereby the rotation of drive sleeve means causes vertical movement of said reaction sleeve means to position said cam means behind said dog means to maintain said dog means in engagement with said dog receiving means, said vertical movement continuing until said stop means contacts said locking finger means, whereupon further rotation of said drive sleeve means causes said reaction sleeve means to draw and said mandrel toward said casing hanger to apply said compressive force on said seal ring, said mandrel, and said casing hanger to effect said seal between said riser and said casing.

10. An apparatus as defined in claim 9, wherein:

said mandrel includes key means;

said reaction sleeve means includes keyway means engaging said key means to constrain said reaction sleeve means to vertical movement in response to rotation of said drive sleeve means; and said apparatus further includes bearing means, mounted within said mandrel and supporting said drive sleeve means, for facilitating rotation of said drive sleeve means.

11. An apparatus as defined in claim 8, wherein said operating tool comprises:

a tool body run by tubing from said vessel through said riser into said mandrel, said tool body having a lower body part positioned within said drive sleeve means and having an upper body part attached by connecting means to said tubing;

vertical registration means, disposed within said lower body part, for positioning said lower body part in said drive sleeve means; and dog means, disposed within said lower body part, for engaging said drive sleeve means, whereby rotation of said operating tool effects rotation of said drive sleeve means.

12. An apparatus as defined in claim 11 wherein:

said drive sleeve means includes annular dog receiving means and annular recess means including a pair of annular grooves having different internal contours;

said dog means comprises a plurality of outwardly-biased dogs circumferentially positioned within said lower body part for engagement said annular dog receiving means, said biasing allowing said dogs to move inwardly to follow the bore of said drive sleeve means as said operating tool is lowered into said drive sleeve means;

said vertical registration means comprises locking collet means for engaging said annular recess means, said locking collet means including a plurality of circumferentially-disposed locking finger means each having a pair of dogs with contours corresponding to the contours of said recess means, whereby said operating tool is lowered into said drive sleeve means until said contours on said pair of annular grooves and on said pair of dogs on said finger means engage, further lowering of said operating tool being thereafter prevented and said dog means engaging said dog receiving means.

13. An apparatus as defined in claim 12 wherein:

one of said annular grooves includes shoulder means for engaging one of said pair of dogs on said finger means;

one of said pair of dogs on said finger means includes a shoulder, said shoulders forming a rim on said locking collet means;

said vertical registration means includes a recess in said lower body part to contain said locking collet means prior to said operating tool entering said drive sleeve, shear pin means disposed above said recess, and flange means for restraining vertical movement of said locking collet means;

said locking collet means includes flexible band means for outwardly biasing said finger means, whereby as said operating tool is lowered into said drive sleeve means, said rim engages said shoulder means to prevent further downward movement of said locking collet means as said operating tool continues downwardly, said continued downward movement of said operating tool causing said locking collet means to be pulled from said recess and shear said shear pin and thereafter to engage said flange, whereupon further downward movement of said running tool is prevented and said dog means on said lower body part engages said annular log receiving means.

14. An operating tool for applying rotative force to a drive sleeve in a tie-back connection apparatus run by a riser from an overhead vessel into a subsea wellhead, said tie-back apparatus having a metal seal ring disposed at the lower end of a tubular mandrel and landed upon a casing hanger supporting a casing in said wellhead, said tie-back apparatus effecting a metal-to-metal seal between said riser and said casing by applying a compressive force to said mandrel, said seal ring, and said casing hanger in response to rotation of said drive sleeve, said operating tool comprising:

a tool body run by tubing from said vessel through said riser into said mandrel, said tool body having a lower body part positioned within said drive sleeve and having an upper body part attached to said tubing;

means connecting said upper body part to said tubing for allowing both clockwise and counterclockwise rotation of said operating tool to rotate said drive sleeve;

vertical registration means, disposed within said lower body part, for positioning said lower body part in said drive sleeve; and dog means, disposed within said lower body part, for engaging said drive sleeve means, whereby rotation of said operating tool effects rotation of said drive sleeve.

* * * * *